US006665889B2

(12) United States Patent
Kim

(10) Patent No.: US 6,665,889 B2
(45) Date of Patent: Dec. 23, 2003

(54) PERSONAL URINE COLLECTING APPARATUS HAVING BIDET SYSTEM

(75) Inventor: Kyoung Hun Kim, Pusan (KR)

(73) Assignee: Hanmedics Co., Ltd., Seoul (KR)

( * ) Notice: Subject to any disclaimer, the term of this patent is extended or adjusted under 35 U.S.C. 154(b) by 165 days.

(21) Appl. No.: 09/930,157

(22) Filed: Aug. 16, 2001

(65) Prior Publication Data

US 2002/0022811 A1 Feb. 21, 2002

(30) Foreign Application Priority Data

Aug. 17, 2000 (KR) ..... 2000-47602
Jul. 26, 2001 (KR) ..... 2001-45202

(51) Int. Cl.[7] ..... A47K 3/22; A47K 3/26

(52) U.S. Cl. ..... 4/443; 4/144.1; 4/420.2; 4/455

(58) Field of Search ..... 4/111.1, 144.1, 4/144.3, 301, 420.2, 443–448, 455, 462, 463; 604/257, 259, 260, 276, 348, 354

(56) References Cited

U.S. PATENT DOCUMENTS 4,622,704 A * 11/1986 Chung ..... 4/443
5,754,988 A * 5/1998 Presa ..... 4/443
5,809,586 A * 9/1998 Kitamura ..... 4/443
6,041,448 A 3/2000 Rempe et al. ..... 4/144.1
6,115,854 A * 9/2000 Haghayegh ..... 4/443

* cited by examiner

*Primary Examiner*—Tuan N. Nguyen
(74) *Attorney, Agent, or Firm*—Staas & Halsey LLP

(57) ABSTRACT

A personal urine collecting apparatus having a bidet system, includes a urine collector for collecting urine from a person, a urine repository for storing urine collected from the urine collector through a urine release guide line, a cleansing water tank arranged on one side of the urine repository for storing cleansing water, a heater connected to the cleansing water tank so as to receive a predetermined amount of the cleansing water and heat the cleansing water, a bidet system installed on in a body of the urine collector for injecting the cleansing water from the heater, a driving means connected to the urine release guide line and cleansing water guide line for actuating the urine collector and the bidet system, a controller for controlling the driving means, a sensing means for sensing a condition of the urine collector and a condition of at least one of the urine repository, cleansing water tank and the heater, and a case for housing and mounting the urine collector, the urine repository, cleansing water tank, the heater, the bidet system, the driving means and the sensing means.

32 Claims, 9 Drawing Sheets

PERSONAL URINE COLLECTING APPARATUS HAVING BIDET SYSTEM

BACKGROUND OF THE INVENTION

1. Field of the Invention

The present invention relates to a personal urine collecting apparatus having a bidet system, which allows a patient to conveniently urinate without help of a caregiver and to wash his/her urination part after urination for sanitary purpose.

2. Background of the Invention

Generally, bed-dependent patients such as serious case and patients having waist down paralysis or degenerative disorder must urinate with the help of one or more nurses. In this case a nurse lifts the patient's pelvis and other one locates a urinal receptacle under the heaps of the patient. However, this may give a bad influence to the patent and make the patient and nurses feel inconvenience.

To avoid these problems, a poly catheter is used. However, the patient suffers great pain and feels uncomfortable since the foley catheter is inserted into the bladder through the urethral carnal. In any case, female patients may feel shameful during the insertion of the catheter.

Furthermore, the foley catheter can cause the urinary organs such urethra and bladder to be infected by virus such that it is difficult to maintain the foley catheter in the body for a long time.

Actually, when the patient shows a symptom of infection such as rigor and fever, the first step is to remove the foley catheter and doses the patient an appropriate antibiotics. This cause to prolong the hospitalization period resulting in increase of medical fee and mental stress.

SUMMARY OF THE INVENTION

The present invention has been made in an effort to solve the above problems of the prior art.

It is an object of the present invention to provide a personal urine collecting apparatus having a bidet system allowing a bed-dependent patient to urinate for oneself without help of a caregiver and allowing even a patient who cannot use his/her arms to urinate in easy way with help of a caregiver.

It is another object of the present invention to provide a personal urine collecting apparatus having a bidet system allowing a patient to conveniently wash his/her urination part by himself/herself after urination so as to keep personal sanitation.

It is another object of the present invention to provide a personal urine collecting apparatus having a bidet system capable of supplying warm cleansing water containing antiseptic solution so as to sterilize an urination part as well as the urine collecting apparatus of itself.

It is another object of the present invention to provide a personal urine collecting apparatus having a bidet system capable of improving reliability of urine collection and cleansing functions by a suction pump operating on the basis of fluid conditions of urine, flushing water, sterilizing solution, and so on detected in a urine collector so that a reliability of the apparatus can be improved.

It is another object of this invention to provide a personal urine collecting apparatus having a bidet system, in which the urine collector of the apparatus is sterilized while the urine collector is placed in a case so as to be kept sanitation thereof and prevent secondary infection.

It is another object of the present invention to provide a personal urine collecting apparatus having a bidet system, in which the user freely controls an injection position of cleansing water so that the urination part can be clearly washed.

It is another object of the present invention to provide a personal urine collecting apparatus having a bidet system, in which a urine guide pipe of the urine collector is detachably connected to allow separation from the case so that cleansing and exchanging is made with easy.

It is another object of the present invention to provide a personal urine collecting apparatus having a bidet system capable of improving a sealing liability of urine collector using flexible and soft sealing material such that the urine collector water-tightly contacts a body, resulting in a patient feeling comfortable.

It is another object of the present invention to provide a personal urine collecting apparatus having a bidet system, in which an urination part-cleansing operation is performed while a urine collector is put on a body.

It is another object of the present invention to provide a personal urine collecting apparatus having a bidet system, in which urine collected by the urine collector are filtered so that a urine discharge pump and a urine release guide line can not be clogged.

It is still another object of the present invention to provide a personal urine collecting apparatus having a bidet system capable of preventing its components from malfunctioning due to inner temperature of the case by discharging heat.

To achieve the above objects, the personal urine collecting apparatus of the present invention comprises a urine collector for collecting urine from a person, a urine repository for storing urine collected from the urine collector through a urine release guide line, a cleansing water tank arranged on one side of the urine repository for storing cleansing water, a heater connected to the cleansing water tank so as to receive a predetermined amount of the cleansing water and heat the cleansing water, a bidet system installed on in a body of the urine collector for injecting the cleansing water from the heater, a driving means connected to the urine release guide line and cleansing water guide line for actuating the urine collector and the bidet system, a controller for controlling the driving means, a sensing means for sensing a condition of the urine collector and a condition of at least one of the urine repository, cleansing water tank and the heater, and a case for housing and mounting the urine collector, the urine repository, cleansing water tank, the heater, the bidet system, the driving means and the sensing means.

BRIEF DESCRIPTION OF THE DRAWINGS

Other objects and aspects of the present invention will become apparent from the following description of embodiments with reference to the accompanying drawing in which.

DETAILED DESCRIPTION OF THE EMBODIMENTS

A preferred embodiment of the present invention will be described hereinafter with reference to the accompanying drawings.

Figure 1:
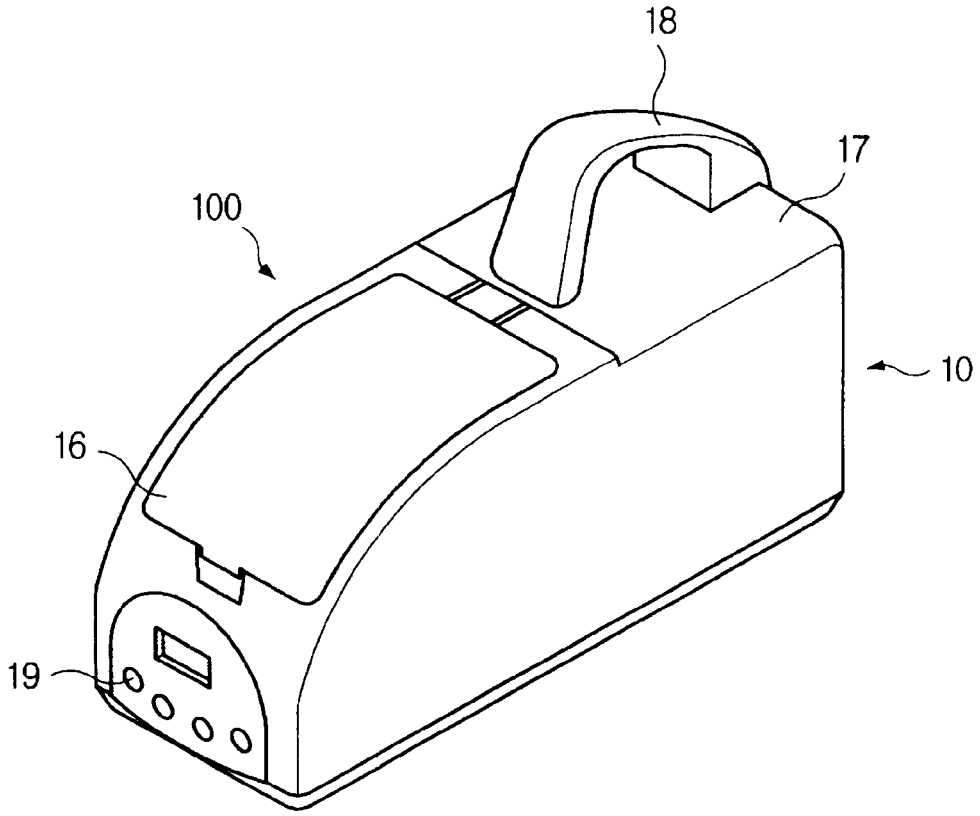
FIG. 1 is a perspective view for showing a configuration of a personal urine collecting apparatus having a bidet system according to the present invention.
Figure 2:
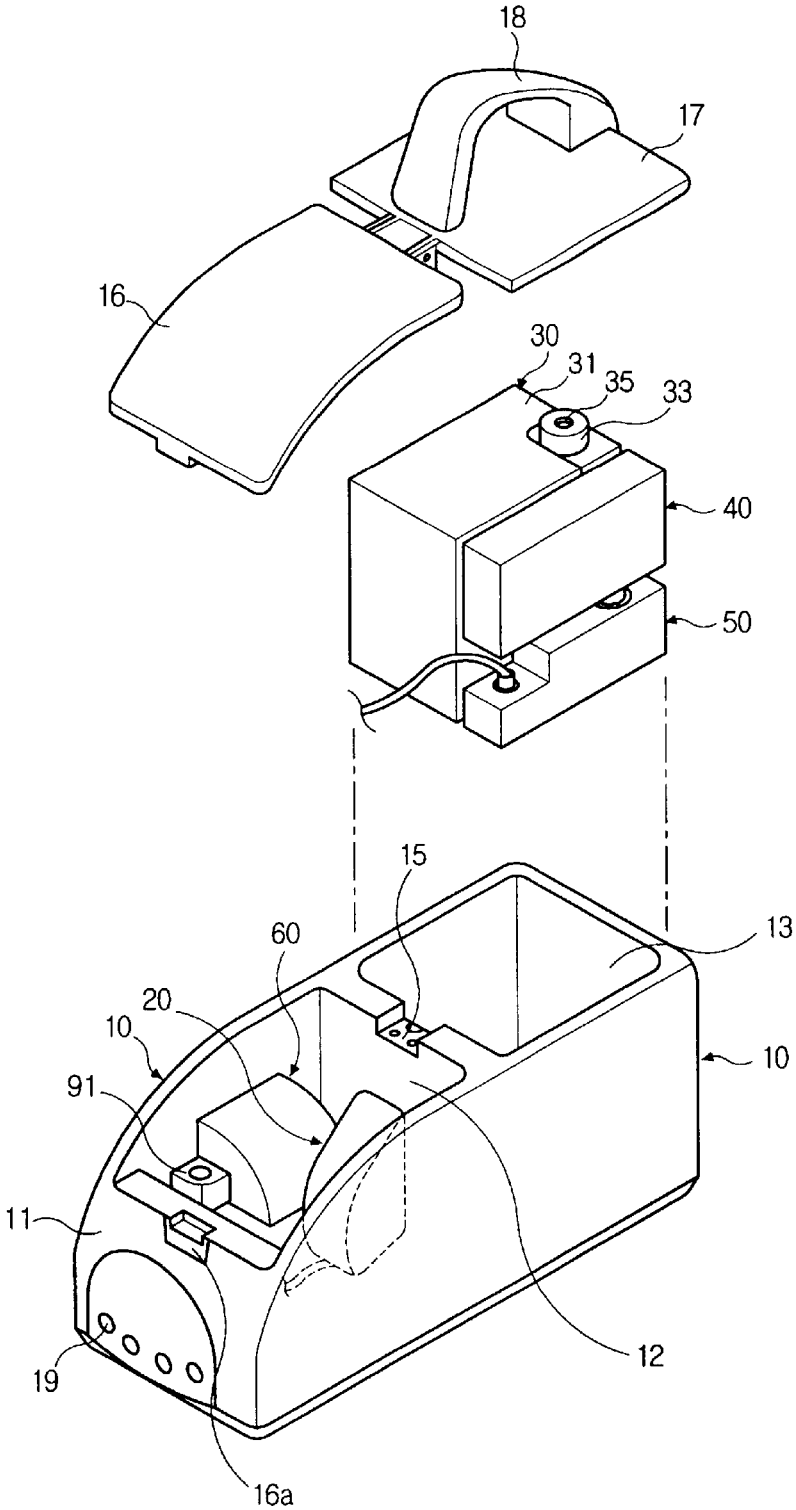
FIG. 2 is an exploded view for showing an internal arrangement of a personal urine collecting apparatus having a bidet system according to the present invention.

FIG. 1 and FIG. 2 are an exterior perspective view and exploded perspective view showing a personal urine collecting apparatus having a bidet system according to a preferred embodiment of the present invention.

As shown in FIGS. 1 and 2, the personal urine collecting apparatus 100 of the present invention comprises a case 10, a urine collector 20 for collecting urine from the user after taking out from the case 10, a urine repository 30 for storing the urine received from the urine collector 20 through a urine release guide line at a predetermined spot, a cleansing water tank 40 arranged on one side of the urine repository 30, a heater 50 being located connected to the cleansing water tank 40 for heating cleansing water to a preset temperature, a bidet system 70 mounted on the urine collector 20 for injecting the cleansing water stored in the heater 50 to a urination part of the user (see FIG. 6), driving means 60 for transporting the urine and cleansing water and being installed in the case 10, and a controller (not shown) for controlling the driving means 60.

The case 10 comprises a case body 11 having a front chamber 12 formed at the front half portion of the case body 11 so as to removably house the urine collector 20 and a rear chamber 13 formed at the rear half portion of the case body 11 so as to house the urine repository 30, cleansing water tank 40, and heater 50, the front and rear chambers 12 and 13 being defined by a partition wall having a hinge mounting bay 15 on an upper end thereof such that a front and rear chamber covers 16 and 17 are pivotally mounted at the hinge mounting bay 15 for covering the front and rear chambers 16 and 17. The rear chamber cover 17 is provided with a handgrip formed on an upper surface thereof.

A switch 19 is installed on a front of the case 10, which is connected to the controller so as to operate the driving means 60.

The urine repository 30 comprises a urine container 31 for storing the urine in storage and being arranged at one side in the rear chamber 13 of the case 10 and a cap 33 fitted on a corner of an upper surface of the urine container 31. The cap 33 is provided with a hole 35 at its center such that one end of a urine pipe 64 installed along the handgrip 18 is connected to the cap 33. The urine container 31 can be a disposable plastic pack so as to be changed when the plastic pack becomes pull.

Further, urine container 31 is provided with an infrared sensor at an upper end portion thereof for detecting amount of the stored urine and sends an alarm signal to the controller such that the controller makes alarm with sound and/or display alarm message on a liquid crystal display (LCD) screen on the basis of the alarm signal from the infrared sensor.

The LCD can display information such as urination amount per one time, total urination amount per day, times of urination per day, average urination amount, and etc.

Figure 3:
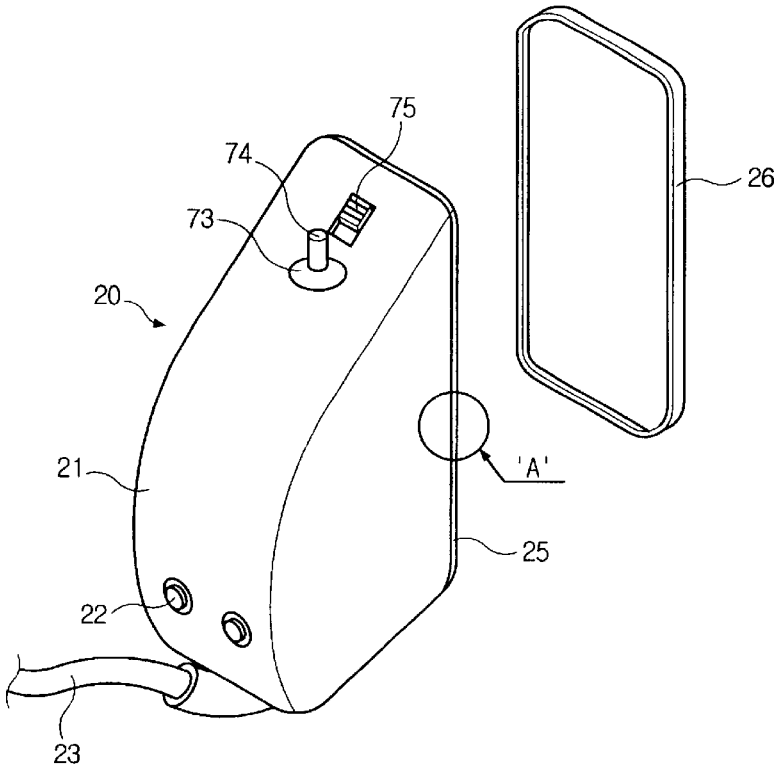
FIG. 3 is a perspective view for showing a urine collector of a urine collector portion according to the present invention.

FIG. 3 shows a perspective view of the urine collector 20 according to the present invention.

As shown in FIG. 3, the urine collector 20 comprises a collector body 21 having a convex shape so as to collect urine which is urinated by the user, a switch 22 installed on the outer side of the collector body 21 and connected to the controller such that the controller operates the driving means 60 on the basis of the switch signal, and a urine guide pipe 23 communicating the urine collector 20 with the urine repository 30. The collector body 21 is provided with a soft packing 25 mounted around its leading edge so as to seal between the user's body and the urine collector 20 when the urine collector is putted on the user's body.

Figure 4:
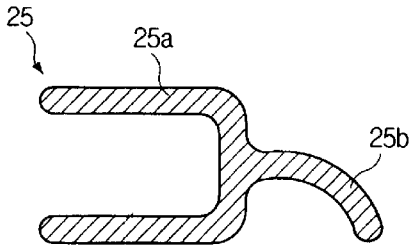
FIG. 4 is a section view for showing one embodiment of soft packing according to the present invention.

FIG. 4 shows an enlarged sectional view of portion "A" of the soft packing 25.

As shown in FIG. 4, the soft packing 25 consists of a adhesive portion 25*a* fitted around a leading edge of the collector body 21 and a close contact 25*b* being bent outwardly at the end of the adhesive portion 25*a*.

Figure 5:
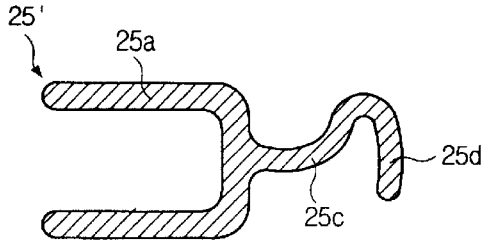
FIG. 5 is another section view for showing one embodiment of soft packing according to the present invention.

FIG. 5 shows an enlarged sectional view of a soft cover according to another embodiment of the present invention.

As shown in FIG. 5, the soft packing 25' consists of an adhesive portion 25*a* being fitted around the leading edge of the collector body 21 of the urine collector 20, an elastic support 25*c* outwardly expanded from the adhesive portion 25*a* and a close contact 25*d* bent outwardly in a shape of hook at the end of the elastic support 25*c*.

The collector body 21 has a detachable cover 26 which can cover the front thereof when sterilization at low temperature or pasteurization is carried out by injecting cleansing water increased in temperature from the bidet system.

Figure 6:
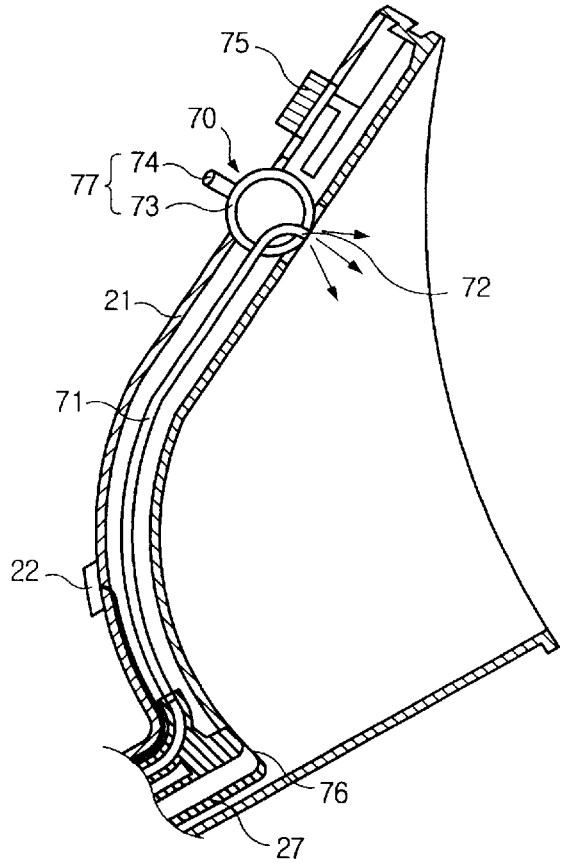
FIG. 6 is a longitudinal sectional view for showing the urine collector of the urine collector according to the present invention.

FIG. 6 is a longitudinal sectional view of the collector body with the bidet system according to the present invention.

As shown in FIG. 6, the bidet system 70 comprises a cleansing water delivery pipe 71 connected to the urine guide pipe 23 so as to supply cleansing water to the upper portion of the collector body 21, and an injection nozzle 72 installed at one end of the cleansing water delivery pipe 71 for injecting cleansing water to the urination part of the user.

Around the injection nozzle 72 is provided a positioning member 77, which is designed to control an injection position of the injection nozzle 72 and rotatably installed for adjusting the injection position. The positioning member 77 comprises a rolling ball 73 with the injection nozzle 72 fixed toward the interior of the collector body 21, and an operating knob 74 formed on the rolling ball 73 in opposite direction of the nozzle.

In addition, on the exterior upper portion of the collector body 21 is slidably fitted a positioning button 75, which causes the rolling ball 73 to be secured at a desired position by getting in close contact with the outer surface of the rolling ball 73.

A filtering net 76 is provided at the outlet on the lower portion of the collector body 21 so that, during urination, pubes or other foreign substances can be filtered.

Figure 7:
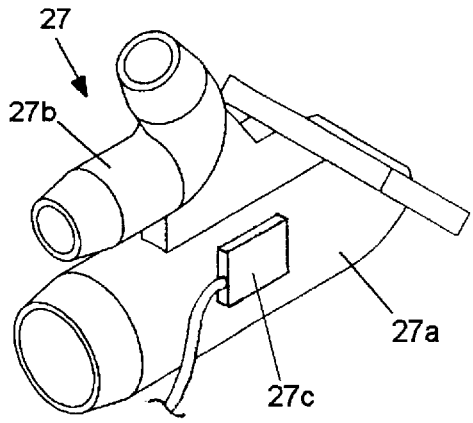
FIG. 7 is a perspective view for showing a release socket outfitted on the lower portion of the urine collector according to the present invention.

FIG. 7 is a perspective view of a release socket outfitted on the lower portion of the collector body according to the present invention.

As shown in FIG. 7, the release socket 27 comprises a urine release portion 27*a* for supplying the collected urine to the urine guide pipe and a cleansing water delivery part 27*b* for supplying the introduced cleansing water to the cleansing water delivery pipe 71. On the opposite sides of the urine release portion 27*a* of the release socket 27, is installed an infrared sensor 27*c* to sense how much urine is collected.

Figure 8:
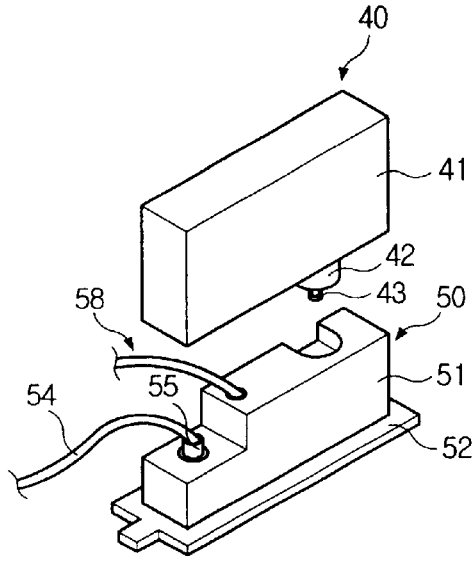
FIG. 8 is perspective view for showing a cleansing water tank and a heater according to the present invention.

FIG. 8 is a perspective view for showing the cleansing water tank and the heater for a certain amount of cleansing water according to the present invention.

As shown in FIG. 8, the cleansing water tank 40 includes a cleansing water tank body 41 designed to contain the cleansing water and having a box shape, a cleansing water delivery port 42 located on one side of the cleansing water tank body 41 to supply the cleansing water to the heater 50 on the lower portion of the cleansing water tank body 41, and a check valve 43 installed at the central hole of the cleansing water delivery port 42 to prevent the cleansing water from flowing in an opposite direction. Furthermore, on one side of the lower portion of the cleansing water tank body 41 is provided an infrared sensor (not shown) which is connected to the controller to detect cleansing water level such that the controller determines whether or not the cleansing water is short, and thereby indicating a warning message on a liquid crystal display or outputting a warning sound with a buzzer. In the drawings, the reference numbers 54 and 55, not described, are indicated as a cleansing water guide line and a coupling cap for the cleansing water guide line.

Figure 9:
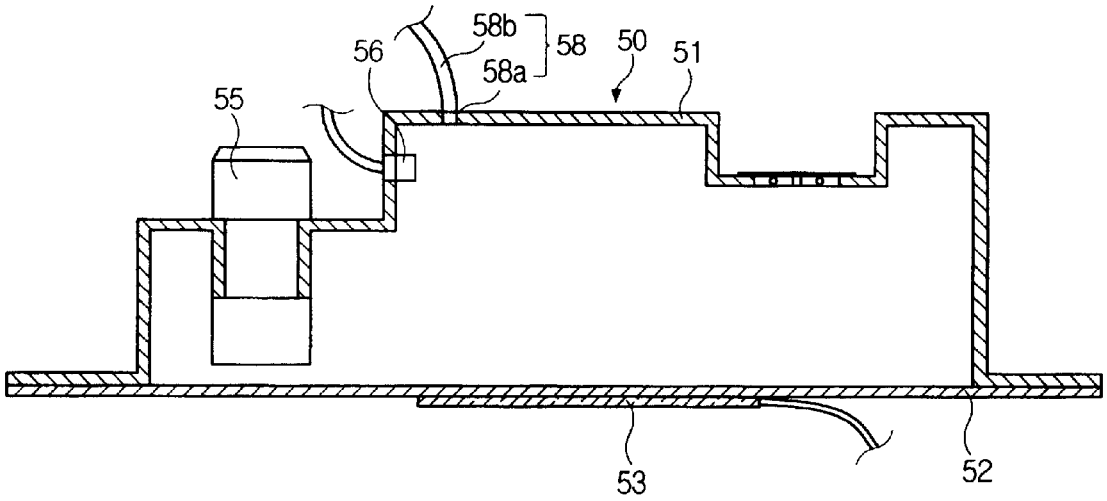
FIG. 9 is a sectional view for showing one embodiment of the heater according to the present invention.

FIG. 9 is a sectional view showing the heater in accordance with one embodiment of the present invention.

As shown in FIG. 9, the heater 50 comprises a heating storage tank 51 being adapted to contain a certain amount of cleansing water which is supplied from the delivery port 42 for the cleansing water and having a box shape, a heat transfer member 52 being disposed on the bottom of the heating storage tank 51, and a heater 53 being closely disposed on one side of the heat transfer member 52 to transmit heat to the heat transfer member 52.

The heater may preferably make use of a ceramic heater which is capable of getting a higher temperature with a low power in a short time.

The heat transfer member 52 is a stainless steel plate which is disposed horizontally on the bottom of the heating storage tank 51. The ceramic heater 53 is closely disposed on the lower surface of the stainless steel plate so that it can heat the cleansing water contained in the heating storage tank 51 at a preset temperature.

On one side of the heating storage tank 51 is fitted an infrared sensor 56 as a sensor for determining the level of the cleansing water, which senses the amount of the cleansing water supplied to the heating storage tank 51 to send a signal to the controller when the cleansing water is short, and thereby the sent signal generates a warning sound from an acoustic device, such as buzzer and so on, to stimulate the user.

Further, on one side of the heater 50 is provided a thermometric sensor (not shown) and a thermostatic switch (not shown). The thermometric sensor is intended to measure a temperature to have automatic control of heating based on the preset temperature, wherein the sensor applies the measured temperature to the controller, and enables the resultant temperature to be indicated on the liquid crystal display in one side of the case 10. The thermostatic switch is designed to block off the electric power which is supplied to the ceramic heater of the heater in the event that the temperature is increased above the pre-set temperature. It is preferable for the thermostatic switch to employ a bimetal switch which is not interfered with various medical equipments. In addition, it is suitable to employ other switches having a function of detecting temperature.

An atmospheric pipe 58 is installed in one side of the heating storage tank 51 in order to get the heating storage tank 51 to be full of the cleansing water. The atmospheric pipe 58 consists of an atmospheric hole 58*a* formed on the upper portion of the heating storage tank 51 of the heater and a bypass tube 58*b* extending from the atmospheric hole 58*a* through the interior of the hand grip to the urine container 31.

Figure 10:
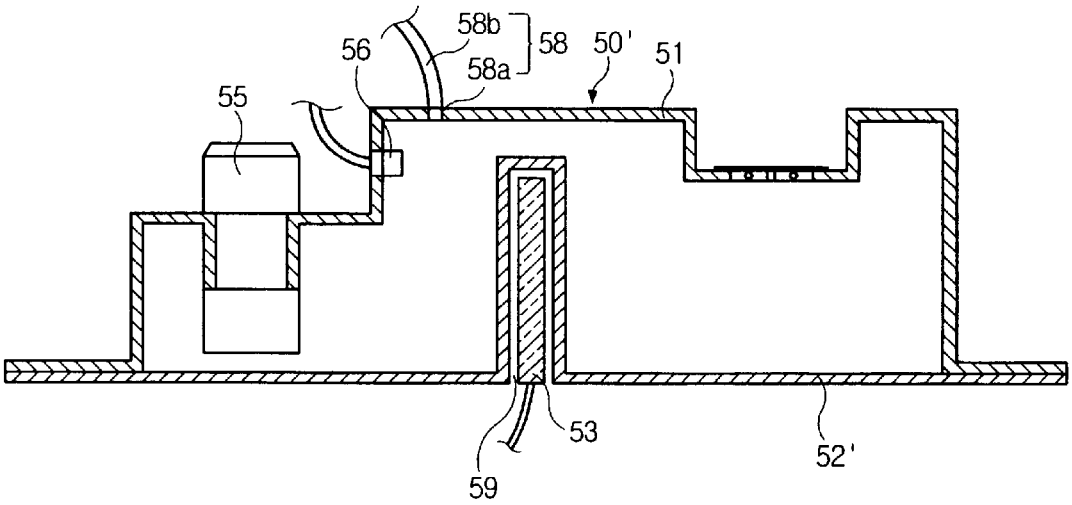
FIG. 10 is another sectional view for showing one embodiment of the heater according to the present invention.

In FIG. 10, another embodiment of the heater 50' according to the present invention is shown.

As shown, the heat transfer member 52' is a stainless steel plate which is protruded toward the interior of the heating storage tank 51 on the central bottom of the heating storage tank 51 to form a heating cavity 59 for inserting the heater. The ceramic heater 53 is inserted into the heating cavity 59 of the stainless steel plate so that it can heat cleansing water in the heating storage tank 51 to a preset temperature.

Figure 11:
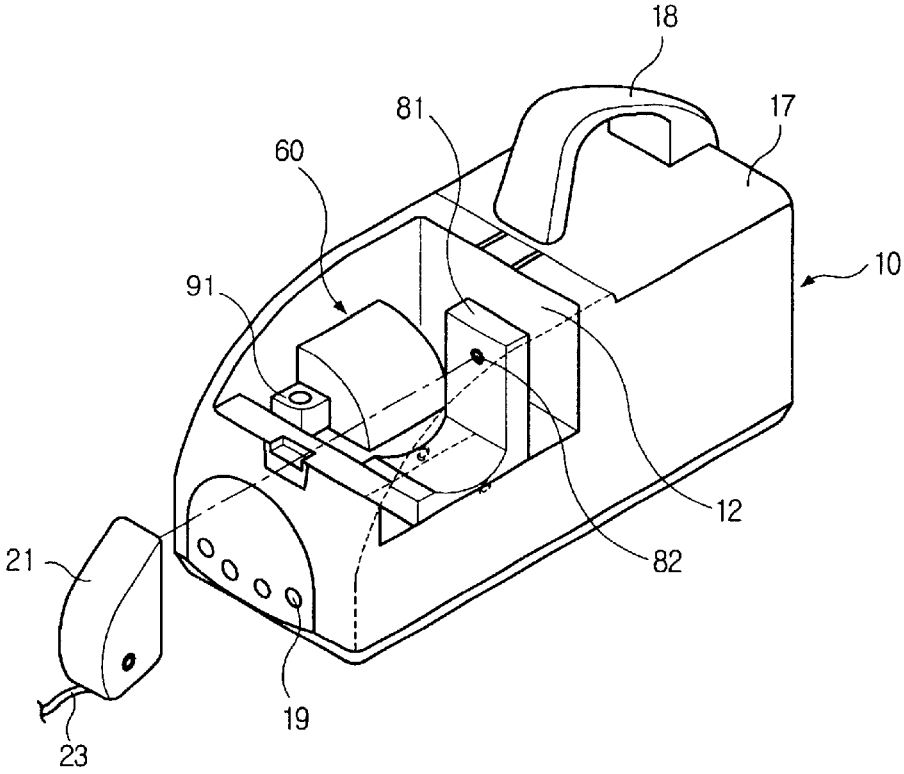
FIG. 11 is a perspective view for showing a cradle of the urine collector of the case according to the present invention.

FIG. 11 is a perspective view of a cradle for the collector body of the case according to the present invention.

As shown in FIG. 11, the cradle 81 is housed on the front chamber 12 of the case 10, on which the collector body 21 is seated. An ultraviolet lamp 82 is fitted on the upper portion of the cradle 81 of the collector body which gives out ultraviolet radiations toward the interior of the collector body 21 to carry out sterilization.

The ultraviolet lamp 82 is designed to emit ultraviolet radiations after the collector body 21 is seated on the cradle 81 and then covered with its front chamber cover 16.

Figure 12:
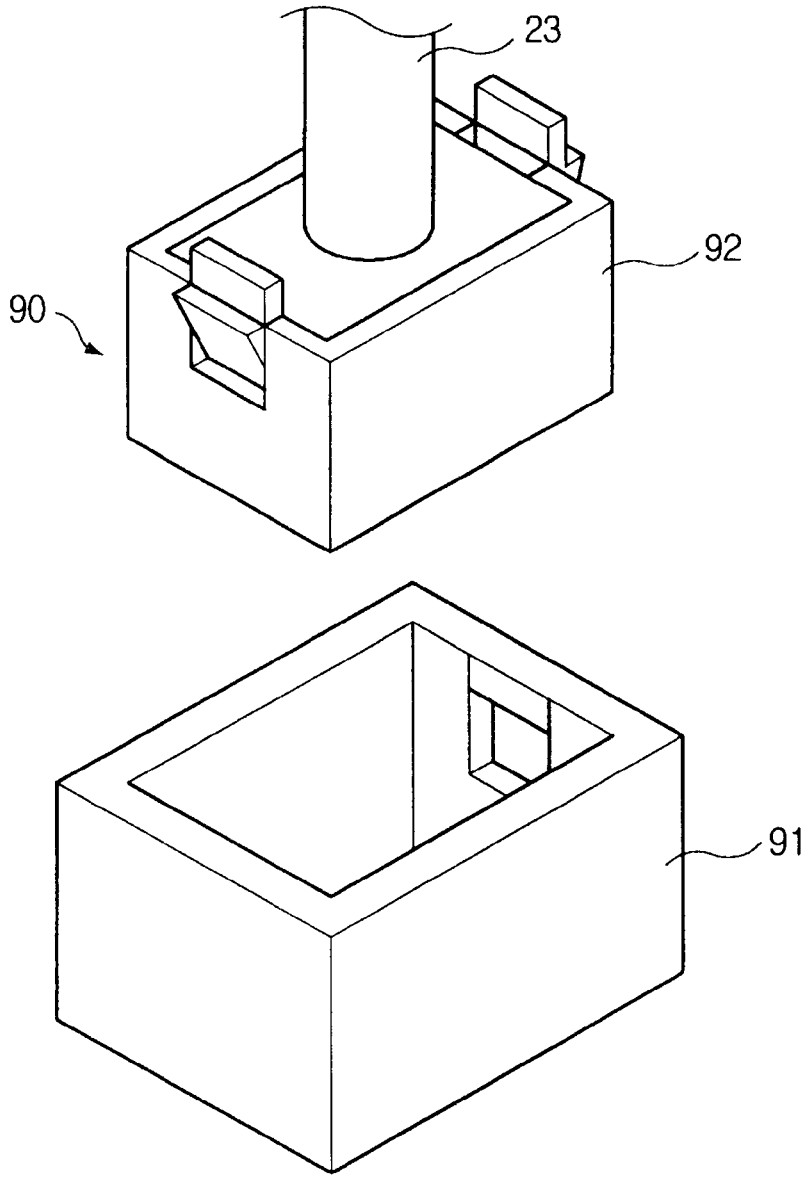
FIG. 12 is a perspective view for showing a disassembly of the coupling member of the urine guide pipe according to the present invention.
Figure 13:
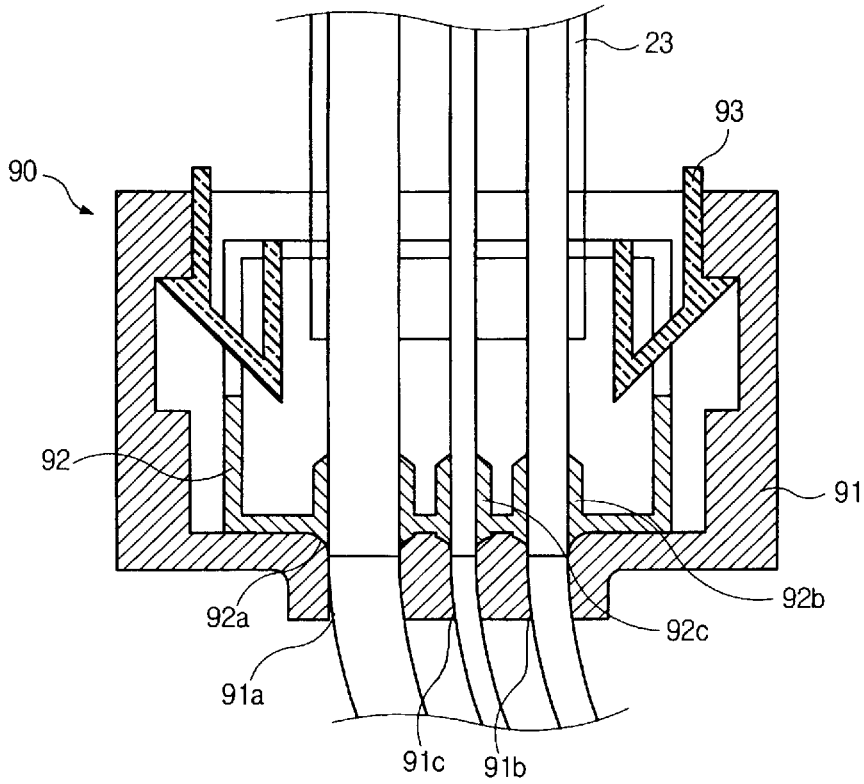
FIG. 13 is a sectional view for showing an assembly of the coupling member of the urine guide pipe according to the present invention.

FIG. 12 is a perspective view for showing a disassembly of the coupling member of the urine guide pipe according to the present invention, and FIG. 13 is a sectional view for showing an assembly of the coupling member of the urine guide pipe according to the present invention.

As can be seen with reference to these FIGS. 12 and 13, a coupler 90 is detachably provided between the urine guide pipe 23 of the urine collector 20 and the case 10, comprising a joint socket 91 disposed on the bottom of the front chamber 12 of the case 10 and a joint plug 92 inserted into and connected with, the joint socket 91.

On the bottom of the joint socket 91 is formed a connector 91*a* for the urine release guide line, a connector 91*b* for the cleansing water guide line and a wire connector 91*c* for the sensor. The joint plug 92 is provided with a plurality of connectors 92*a*, 92*b* and 92*c*, each of which is connected to each of corresponding connectors 91*a*, 91*b* and 91*c*. A locking hook 93 is formed on the opposite sides of the joint plug 92 which is elastically connected after insertion of the joint socket 91.

Such a construction that the urine guide pipe 23 is detachably connected on one side of the front chamber of the case as described above may be applied to other constructions in the similar manner. Therefore, this construction would be provided such that a detachable connection is made not only between the urine guide pipe 23 and the case 10, but also between the urine guide pipe 23 and the collector body 21, thereby allowing the collector body 21 to be exchanged or sterilized.

Figure 14:
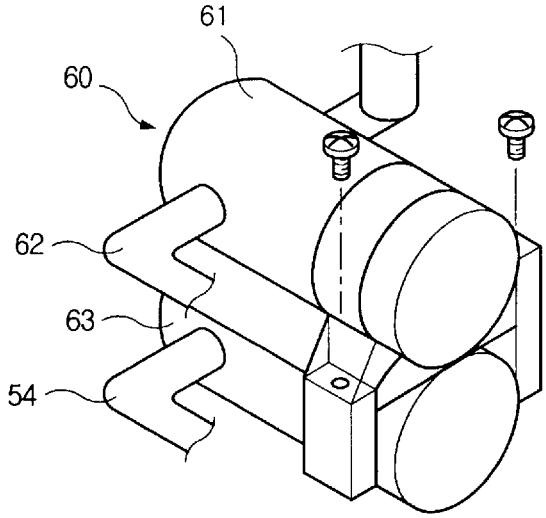
FIG. 14 is a perspective view for showing a driving means according to the present invention.

FIG. 14 as a perspective view of the driving means in accordance with the present invention.

As shown in FIG. 14, the driving means 60 comprises a urine discharge pump 61 being fitted on one side of the urine release guide line 62 to transport urine collected at the collector body 21 to the urine container 31 and a bidet pump 63 being fitted on one side of the cleansing water guide line 54 to transport cleansing water stored at the heating storage tank 51 to the bidet system 70 of the collector body 21.

As for the urine discharge pump 61, it is preferable to employ a high-powered compact suction pump which is capable of dealing with the maximum urine of an average normal person, on, abou ml/sec, and which is integrated with a low voltage/current motor with low energy consumption.

Also, the bidet pump 63 makes use of a pump having a performance that it is possible for the cleansing water to be injected to the pressure of 20 mbar and the amount of 5to 7ml/sec.

Figure 15:
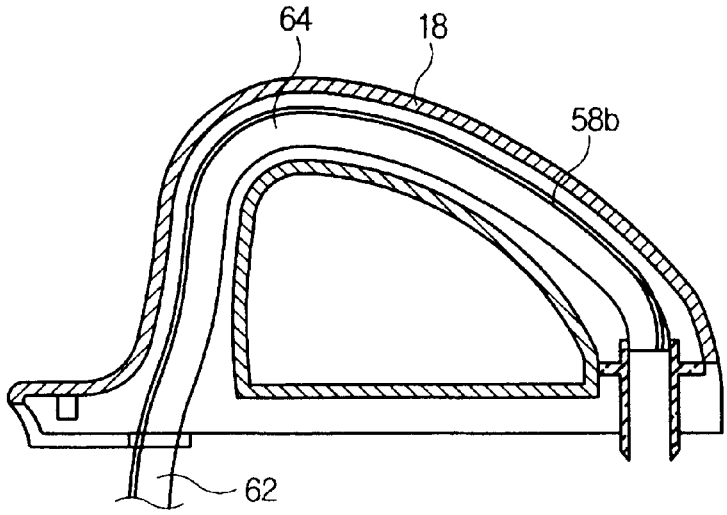
FIG. 15 is a sectional view for showing a hand grip of the case according to the present invention.

FIG. 15 is a sectional view for showing the hand grip of the case according to the present invention.

As shown in FIG. 15, a urine delivery pipe 64 is provided at the interior of the handgrip 18 which makes the urine release guide line 62 and the urine container 31 of the urine collector to be connected with each other. The urine delivery pipe 64 is constructed to be fitted into the through hole 35 on the cap 33 of the urine container 31 when the rear chamber cover 17 of the case is covered.

Figure 16:
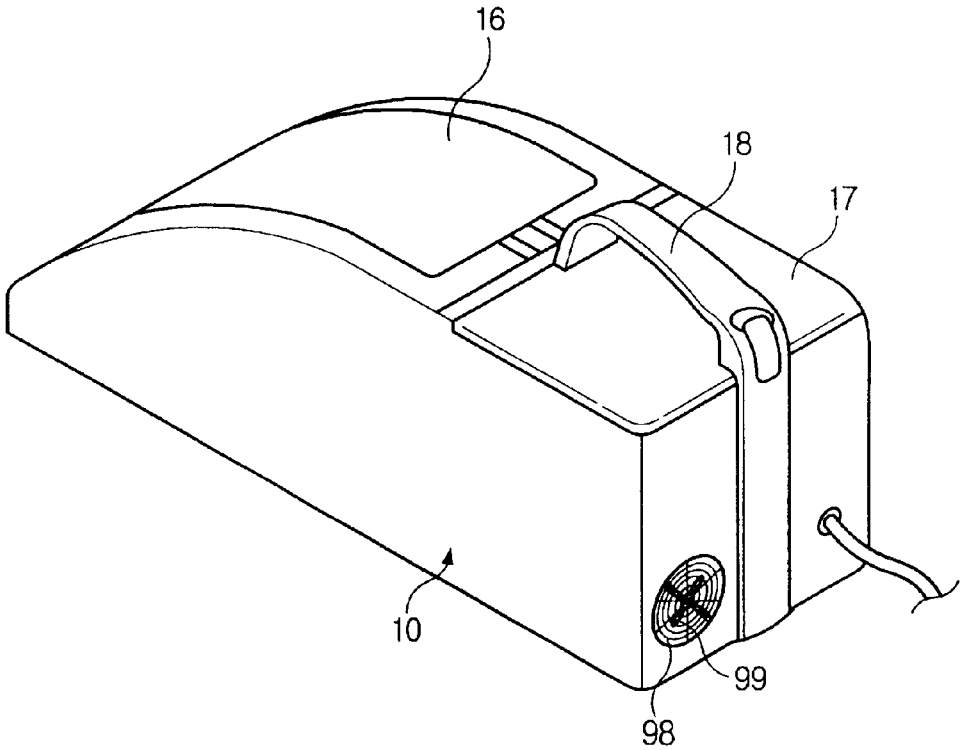
FIG. 16 is a perspective view for showing the rear section of the case of the present invention.

FIG. 16 is a perspective view of the rear section of the case of the present invention.

As shown in FIG. 16, a heat release opening 98 is provided in the rear side of the case 10. A fan 99 with a compact motor for releasing heat is mounted to the inside of the heat release opening 98 to cool the interior of the case.

In the following, the personal urine collecting apparatus with the bidet system according to the present invention will be described on its operations and effects in detail.

For urination, a user who is a physically uncomfortable person opens the front chamber cover 16 of the case 10 and takes out the collector body 21 in the front chamber 12 of the case 10. Then, once a button 16*a* at the front of the case 10 is pushed down to open the front chamber cover 16, a locking claw of the button 16*a* is pushed to disengage with the lower portion of the front chamber cover 16. As a result, the front chamber cover 16 is elastically opened by a coil spring mounted on the hinge 15 of the case 10.

Subsequently, the collector body 21 is brought to the urination part of the user to be close contact with the urination part. A soft packing 25 disposed along to the end of the collector body 21 comes into close contact surround the urination part. In particular, the soft packing 25 is made of a physically friendly silicon material, and resulting in no adverse effect even when it is used over a long period of time. As shown in FIG. 4, since an adhesive portion 25*a* of the soft packing 25 is provided with a close contact 25*b* which is bent outwardly on the end of the adhesive portion 25*a,* the collector body 21 may be used with a soft and comfortable feeling owing to the elastic force of the close contact 25*b* when the collector body 21 is brought into close contact with the urination part. Furthermore, as the collector body 21 is brought into close contact around the urination part of the user, the close contact 25*b* is deployed to become bent outwardly with a close contact state. As a result, the collector body 21 exerts a good water-tight property and helps a natural urination.

The soft packing 25 may be made in various shapes other than that as discussed above. As shown in FIG. 5, an elastic middle support 25*c* can be added intermediate to ensure softer touch feeling.

Urine is collected into the urine collecting space of the collector body 21 when urination is done with the contact 25*b* of silicon material contacted closely to the urination part. The collected urine in the collector body 21 is sensed by an infrared sensor 27*c* on both sides of a release socket 27 disposed on the lower portion of the collector body 21 to send a signal to the controller, the sent signal drives the urine discharge pump 61 to transport the collected urine to a urine repository 30.

With a more description on transport of the collected urine to the urine repository 30, the urine discharge pump 61 is driven to suck the collected urine, the sucked urine is transported, in turn, along to a urine guide pipe 23 connected to the collector body 21, along to a urine discharge guide line on the interior of the case, along to a urine delivery pipe 64, through the through hole 35 on the cap 33 of the urine container 31, and then the transported urine is introduced into and stored the urine container 31.

Here, the detachable filtering net 76 at the outlet port of the collector body 21 is adapted to filter pubic hair, wastes and so on.

On one hand, the infrared sensor 27*c* fitted on the release socket 27 of the collector body 21 is attached on the outer side of a urine release portion 27*a* made of a transparent material so that it can sense not only urine but also various fluids, such as cleansing water, sterilizing solution, etc. with infrared radiations without contact with these fluids. As a result, a sanitary environment can be ensured along with a positive operation of the sensor.

When urination has been completed, it is sensed by the infrared sensor 27 fitted on the release socket 27 of the collector body 21. The resulting signal is applied to the controller so that the urine discharge pump 61 of the driving means would stop operating.

On the other hand, the user who has completed his/her urination presses an operation switch 19 located at the front of the case 10 to put a bidet pump 63 in motion. In this case, the bidet pump 63 may be driven not only by the operation switch 19 located at the front of the case 10, but by the operation switch 22 located at the front of the collector body 21. In other words, the bidet system can be driven with easy and simple by the switch which the user or caregiver is convenient to operate. Optionally, the bidet system may be automatically driven in a predetermined time without a separate switch in an automatic control mode in place of the manual mode.

If the bidet pump 63 is driven, the cleansing water contained in a heater 50 is pumped to be injected into a bidet system 70 of the collector body 21 by way of a flushing line 54.

For more description on the path which the cleansing water flows from the heater 50 to the bidet system 70, the cleansing water pumped by the bidet pump 63 flows along to the cleansing water guide line 54 connected to the heating storage tank 51, through a cleansing water delivery pipe in the urine guide pipe 23 to reach the collector body 21. This cleansing water arrived at the collector body 21 flows along to the cleansing water delivery pipe 71 in the collector body 21. The cleansing water supplied by the cleansing water delivery pipe 71 is injected into the user's urination part by the injection nozzle 72 and cleanses it.

At this time, the user adjusts an injection position for cleansing with an positioning member 77 installed in the outer side of the collector body 21 to control the injection position with the collector body 21 come into close contact.

In detail, an operating knob 74 of the positioning member 77 is grasped to put a rolling ball 73 in rotational motion. The rotating rolling ball 73 allows the injection nozzle 72 fixed on the lower end of the rolling ball 73 to be shifted, thereby controlling the injection position. When the injection position is set, a positioning button 75 fitted on one side of the operating knob 74 is pulled downward to closely contact on the outer surface of the rolling ball 73 so that the injection nozzle 72 is fixed for its position.

Subsequently, the cleansing water injected from the injection nozzle 72 is heated to a proper temperature by the ceramic heater 53 installed on the heater 50 (see FIG. 9) so that it is convenient for the user to use it. To mention it in detail, the ceramic heater 53 is supplied with currents by the controller, the ceramic heater 53 generates heat. This heat is transmitted to a heat transfer member 52 which is a stainless steel plate on the heater. The heat transmitted to stainless steel plate heats cleansing water in the heater 50 on the plate so that the cleansing water maintains at a temperature convenient for the user to use it.

To increase heat transfer efficiency, as shown in FIG. 10, the ceramic heater 53 is closely inserted into the stainless steel plate which is recessed at its middle portion. Therefore, the heat can be transferred to both sides of the ceramic heat 53 to increase its efficiency.

When the cleansing water heated to such a proper temperature is spent in a bidet mode, the cleansing water is supplied from the storage tank 41 disposed above the heating storage tank 52 to be heated again. The cleansing water is heated only by a desired amount so that the cleansing water can be heated to a desired temperature in a short time and loss in electric power can be decreased.

In this case, when the cleansing water is filled up, air in the heating storage tank 51 is escaped through an atmospheric pipe 58 of the heating storage tank 51. To be specified on this, when the cleansing water is filled up in the heating storage tank 51, air in the heating storage tank 51 flows through a bypass tube 58*b* from an atmospheric hole 58*a*. The air past the bypass tube 58*b* flows along to the interior of the hand grip of the case to the urine container 31. Therefore, the cleansing water is filled with ease because the pressure difference between interior and exterior of the heating storage tank 51 is eliminated. In addition, such an atmospheric pipe 58 may be used when the flushing is removed by rotating the bidet motor in a reverse direction.

Meanwhile, the ceramic heater 53 of the heater 50 is carried out a pasteurization which is generally to sterilizes a substance, especially a liquid in part at a temperature between 63 to 65° C. and for a period of thermal exposure that destroys objectionable organisms without major chemical alteration of the substance. The ceramic heater 53 is pre-set at a proper temperature, i.e. between 63 to 65° C., for pasteurization by the controller, and then the bidet pump is driven for a period or so between a half to one hour, wherein a hot water between 63 to 65° C. is injected into the interior of the collector body 21. In this case, the pasteurization has to be carried out with the cover 26 of the collector body 21 covered.

Carrying out such a pasteurization, the hot water sterilizes and cleanses the apparatus while it flows, in turn, the cleansing water line 54, the flushing transporting pipe, the flushing delivery pipe 71 and the collector body 21.

With applications to this principle, it is possible to affect a function as bidet as well as a function of sterilizing and deterging any flesh wound. To this end, after the pasteurization, an antiseptic is charged into the cleansing water tank body 41, the collector body 21 is closely contacted around any flesh wound of a patient, the injection nozzle 72 is controlled to direct toward the flesh wound, and a bidet mode is carried out. Therefore, the injection nozzle 72 of the bidet system 70 is adapted to cleanse and sterilize the wound of the patient for several times, the injected antiseptic solution is collected into the urine container 31 along with a foreign substances, such as blood, pus and so on. The used urine container 31 is disassembled and connected again after cleansing, the wound, such as a decubitus, a hemorrhoid, etc., is sterilized and cleansed.

Subsequently, when the collector body 21 is used up, the collector body 21 is entered into the front chamber 12 of the case 10 along with the urine guide pipe 23 and then the front chamber cover 16 is shut.

Here, before the front chamber cover 16 is shut, the collector body 21 is seated onto the cradle 81 of the case 10, wherein the ultraviolet lamp 82 fitted on the vertical side of the cradle 81 is illuminated toward the interior of the collector body 21 to sterilize it. In this case, the ultraviolet lamp 82 must be preferably operated only when the front chamber cover 16 is shut.

Also, if there is any message that the collector body 31 is full of urine by the liquid crystal display of the case 10 or the warning sound of the buzzer, the rear chamber cover 17 covered on the rear half portion of the case 10 is pivoted about the hinge 15 to be opened. The urine container 31 is taken out of the rear chamber 13 of the case 10. The urine container 31 causes its cap 33 to be opened and its contents to be emptied. Then, the urine container 31 is kept in place again, the rear chamber cover 17 is covered.

Similarly, if there is any message that the cleansing water tank body 41 is short of water by the liquid crystal display of the case 10 or the warning sound of the buzzer, the rear chamber cover 17 of the case 10 is pivoted about the hinge 15 to be opened. The cleansing water tank body 41 is taken out. The cleansing water tank body 41 is filled with the cleansing water and held in place again, the rear chamber cover 17 is covered.

In addition, the heat release opening 98 is formed on the rear end of the case 10, and the fan 99 with a compact motor on the inside of the heat release opening 98 is designed to give off heat from the interior to exterior of the case 10, so that it is possible to prevent the apparatus from being malfunctioned.

While there have been illustrated and described what are considered to be preferred specific embodiments of the present invention, it will be understood by those skilled in the art that the present invention is not limited to the specific embodiments thereof, and various changes and modifications and equivalents may be made without departing from the scope of the present invention.

What is claimed is:

1. A personal urine collecting apparatus having a bidet system, comprising:

a urine collector for collecting urine from a person;

a urine repository for storing urine collected from the urine collector through a urine release guide line;

a cleansing water tank arranged on one side of the urine repository for storing cleansing water;

a heater connected to the cleansing water tank so as to receive a predetermined amount of the cleansing water and heat the cleansing water;

a bidet system installed on in a body of the urine collector for injecting the cleansing water from the heater;

driving means connected to the urine release guide line and cleansing water guide line for actuating the urine collector and the bidet system;

a controller for controlling the driving means;

sensing means for sensing a condition of the urine collector and a condition of at least one of the urine repository, cleansing water tank and the heater; and a case for housing and mounting the urine collector, the urine repository, cleansing water tank, the heater, the bidet system, the driving means and the sensing means.

2. The personal urine collecting apparatus as claimed in claim 1, wherein the urine collector comprises:

a collector body;

a infrared sensor mounted around an outlet port on the lower portion of the collector body and sensing the collected urine; and a urine guide pipe connected the outlet port of the collector body to the case.

3. The personal urine collecting apparatus as claimed in claim 2, wherein the urine collector is provided with a cover for covering an opening of the collector body.

4. The personal urine collecting apparatus as claimed in claim 2, further comprising a coupling for coupling the urine guide pipe and the case.

5. The personal urine collecting apparatus as claimed in claim 4, wherein the coupling member comprises:

a joint socket mounted on one side of the case, and connected to the urine release guide line, the cleansing water guide line, and a wire for the sensor; and a joint plug mounted on the end of the urine guide pipe, and inserted into and removably connected with the joint socket.

6. The personal urine collecting apparatus as claimed in claim 1, wherein the collector body is provided with a soft packing around its leading edge.

7. The personal urine collecting apparatus as claimed in claim 6, wherein the soft packing comprises:

an adhesive portion fitted on the leading edge of the collector body; and a close contact outwardly expanded from the adhesive portion for sealing between the urine collector and the body of the user.

8. The personal urine collecting apparatus as claimed in claim 6, wherein the soft packing comprises:

an adhesive portion mounted along the leading edge of the collector body;

an elastic support expanded from the adhesive portion and bent inwardly for providing elastic force; and a close contact expanded from the elastic support and bent outwardly for sealing between the urine collector and the body.

9. The personal urine collecting apparatus as claimed in claim 1, wherein the urine collector is provided with a filter for filtering the urine at an outgoing port.

10. The personal urine collecting apparatus as claimed in claim 1, wherein the urine collector is provided with an operating switch on an outer surface thereof and connected to the controller for actuating the driving means.

11. The personal urine collecting apparatus as claimed in claim 1, wherein the cleansing water tank comprises:

a cleansing water tank body for storing the cleansing water;

a cleansing water delivery port formed on one side of the cleansing water tank body for supplying the cleansing water to the heater; and a check valve installed in the cleansing water delivery port for preventing the cleansing water from flowing in an opposite direction.

12. The personal urine collecting apparatus as claimed in claim 1, wherein the heater comprises:

a heating storage tank for temporarily storing a predetermined amount of cleansing water;

a heat transfer member mounted on the bottom of the heating storage tank; and a heater closely disposed on one side of the heat transfer member to transmit heat to the heat transfer member.

13. The personal urine collecting apparatus as claimed in claim 12, wherein the heater is a ceramic heater.

14. The personal urine collecting apparatus as claimed in claim 12, wherein the heat transfer member is an oxidation protection surface treated metal plate horizontally disposed on one side of the heating storage tank, and the heater is closely contacted horizontally on the lower surface of the metal plate.

15. The personal urine collecting apparatus as claimed in claim 12, wherein the heat transfer member is an oxidation protection surface treated metal plate which is protruded toward the interior of the heating storage tank on the bottom of the heating storage tank to form a heating cavity, and the heater is inserted into the heating cavity of the metal plate.

16. The personal urine collecting apparatus as claimed in claim 1, further comprising a thermometric sensor installed on one side of the heater for measuring a temperature to be indicated on the liquid crystal display in one side of the case.

17. The personal urine collecting apparatus as claimed in claim 1, further comprising a thermometric sensor installed on one side of the heater, the thermometric sensor measuring a temperature to send the measured temperature to the controller so that heating is automatically controlled based on a predetermined temperature.

18. The personal urine collecting apparatus as claimed in claim 1, further comprising a thermostatic switch mounted on one side of the heater for blocking an electric power supplied to the heater when increasing above the preset temperature.

19. The personal urine collecting apparatus as claimed in claim 18, wherein the thermostatic switch is a bimetal switch.

20. The personal urine collecting apparatus as claimed in claim 1, further comprising a sensor for determining water level installed on one side of the heater for sensing an amount of the cleansing water and sends a signal corresponding the sensed amount to the controller to generate a warning.

21. The personal urine collecting apparatus as claimed in claim 1, further comprising an atmospheric pipe installed on one side of the heater for filling up the cleansing water in a heating storage tank of the heater.

22. The personal urine collecting apparatus as claimed in claim 21, wherein the atmospheric pipe includes:

an atmospheric hole formed on the upper portion of the heating storage tank of the heater; and a bypass tube extending from the atmospheric hole through the interior of the handgrip to the urine container.

23. The personal urine collecting apparatus as claimed in claim 1, wherein the bidet system includes:

a cleansing water delivery pipe connected with the urine guide pipe to supply cleansing water to one side of the collector body of the urine collector; and an injection nozzle installed on one end of the cleansing water delivery pipe for injecting cleansing water to the urination part of the user.

24. The personal urine collecting apparatus of claim 23 further comprises a positioning member provided on one side of the collector body of the urine collector for controlling an injection position of the injection nozzle.

25. The personal urine collecting apparatus as claimed in claim 24, wherein the positioning member for controlling the injection position comprises:

a rolling ball rotatably installed on the collector body for adjusting the cleansing water injection position with the injection nozzle directed to the interior of the collector body;

an operating knob formed on the outer surface of the rolling ball for manipulating the rolling ball; and a positioning button slidably fitted on one side of the collector body, and fixing a position of the rolling ball by getting in close contact with the outer surface of the rolling ball.

26. The personal urine collecting apparatus as claimed in claim 1, wherein the driving means comprises:

a urine discharge pump mounted on one side of the urine discharge guide line so as to transport urine collected at the collector body to a urine container of the urine repository; and a bidet pump fitted on one side of the cleansing water guide line to transport cleansing water stored at the heating potion to the urine collector.

27. The personal urine collecting apparatus of claim 26 wherein the urine container is a disposable plastic pack.

28. The personal urine collecting apparatus as claimed in claim 1, wherein the case comprises:

a case body;

a front chamber formed at a front half portion of the case body to removably house the urine collector;

a rear chamber formed at a rear half portion of the case body to house and maintain the urine repository, the cleansing water depositing potion, and the heater;

a partition wall having a hinge mounting bay formed on an upper surface of the partition wall, the partition wall defining the front and rear chamber;

a front chamber cover pivotally mounted in the hinge mounting bay for covering the front chamber;

a rear chamber cover pivotally mounted in the hinge mounting bay for covering the rear chamber; and a handgrip formed on an upper surface of the rear chamber cover.

29. The personal urine collecting apparatus of claim 28 further comprises a cradle installed in the front chamber of the case, on which the collector body is seated; and an ultraviolet lamp installed on one side of the cradle of the collector body for radiating ultraviolet rays toward the interior of the collector body to carry out sterilization.

30. The personal urine collecting apparatus of claim 28 further comprises a urine delivery pipe installed in the handgrip for connecting between the urine guide pipe of the urine collector and the urine container of the urine repository.

31. The personal urine collecting apparatus of claim 1 further comprises an operating switch fitted on one side of the case and connected to the controller to drive the driving means.

32. The personal urine collecting apparatus of claim 1 further comprises a heat release opening formed on the rear side of the case; and a fan and a compact motor mounted inside the heat release opening to ventilate inside the case.

* * * * *